US007748866B2

(12) United States Patent
Pan

(10) Patent No.: US 7,748,866 B2
(45) Date of Patent: Jul. 6, 2010

(54) LIGHTING ORNAMENT INCLUDING REFRACTIVE ELEMENTS

(76) Inventor: Kuo-An Pan, Unit 12-13, 11F, Harbour Centre Tower 1, No. 1 Hok Cheung Street Ong Hom, Kowloon, Hong Kong (CN)

( * ) Notice: Subject to any disclaimer, the term of this patent is extended or adjusted under 35 U.S.C. 154(b) by 101 days.

(21) Appl. No.: 12/035,251

(22) Filed: Feb. 21, 2008

(65) Prior Publication Data

US 2009/0213578 A1 Aug. 27, 2009

(51) Int. Cl.
*F21V 33/00* (2006.01)

(52) U.S. Cl. ..... 362/249.16; 362/249.06; 362/806; 362/124

(58) Field of Classification Search ..... 362/121–124, 362/806, 249.06, 249.16, 358, 360, 367, 362/434, 252
See application file for complete search history.

(56) References Cited

U.S. PATENT DOCUMENTS 1,134,834 A * 4/1915 Fisher ..... 362/296.01
5,921,668 A * 7/1999 Bayer ..... 362/404
6,663,259 B2 * 12/2003 Westfall ..... 362/145
6,905,229 B2 * 6/2005 Fan ..... 362/235
7,128,445 B1 * 10/2006 Karkay ..... 362/343
7,290,900 B1 * 11/2007 Tsai ..... 362/806
7,334,912 B1 * 2/2008 Chung et al. ..... 362/124
2007/0291341 A1 12/2007 Pan

OTHER PUBLICATIONS

U.S. Appl. No. 11/730,397, filed Apr. 2, 2007, Pan.
U.S. Appl. No. 11/938,380, filed Nov. 12, 2007, Pan.

* cited by examiner

*Primary Examiner*—Anabel M Ton
(74) *Attorney, Agent, or Firm*—Oblon, Spivak, McClelland, Maier & Neustadt, L.L.P.

(57) ABSTRACT

A decorative lighting apparatus comprising a structure, a plurality of light emitting elements configured to emit light, and a plurality of refractive elements each having a plurality of surfaces. The plurality of refractive elements is connected to the structure such that the plurality of light emitting elements emits light through the plurality of refractive elements to a viewer to refract the light in a plurality of directions.

28 Claims, 7 Drawing Sheets

LIGHTING ORNAMENT INCLUDING REFRACTIVE ELEMENTS

BACKGROUND OF THE INVENTION

1. Field of the Invention

The present invention relates to decorative lighting apparatuses. More specifically, the present invention relates to decorative lighting apparatuses including refractive elements.

2. Description of the Related Art

Decorative lighting apparatuses are often used as holiday decorations, especially for holidays such as Christmas and Halloween. However, related decorative lighting apparatuses typically include a light located above a reflective surface, which has a limited interest as the decoration looks very similar from different viewing angles. Accordingly, a more interesting decoration is desired, especially a decoration that presents a user with a view that changes as a viewer changes position with respect to the decoration.

SUMMARY OF THE INVENTION

The present invention broadly comprises a decorative lighting apparatus including a structure, a plurality of light emitting elements configured to emit light, and a plurality of refractive elements with each refractive element having a plurality of surfaces. The plurality of refractive elements is connected to the structure such that the plurality of light emitting elements illuminates the plurality of refractive elements. The plurality of light emitting elements is configured to emit light through the surfaces of each of the plurality of refractive of elements to a viewer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
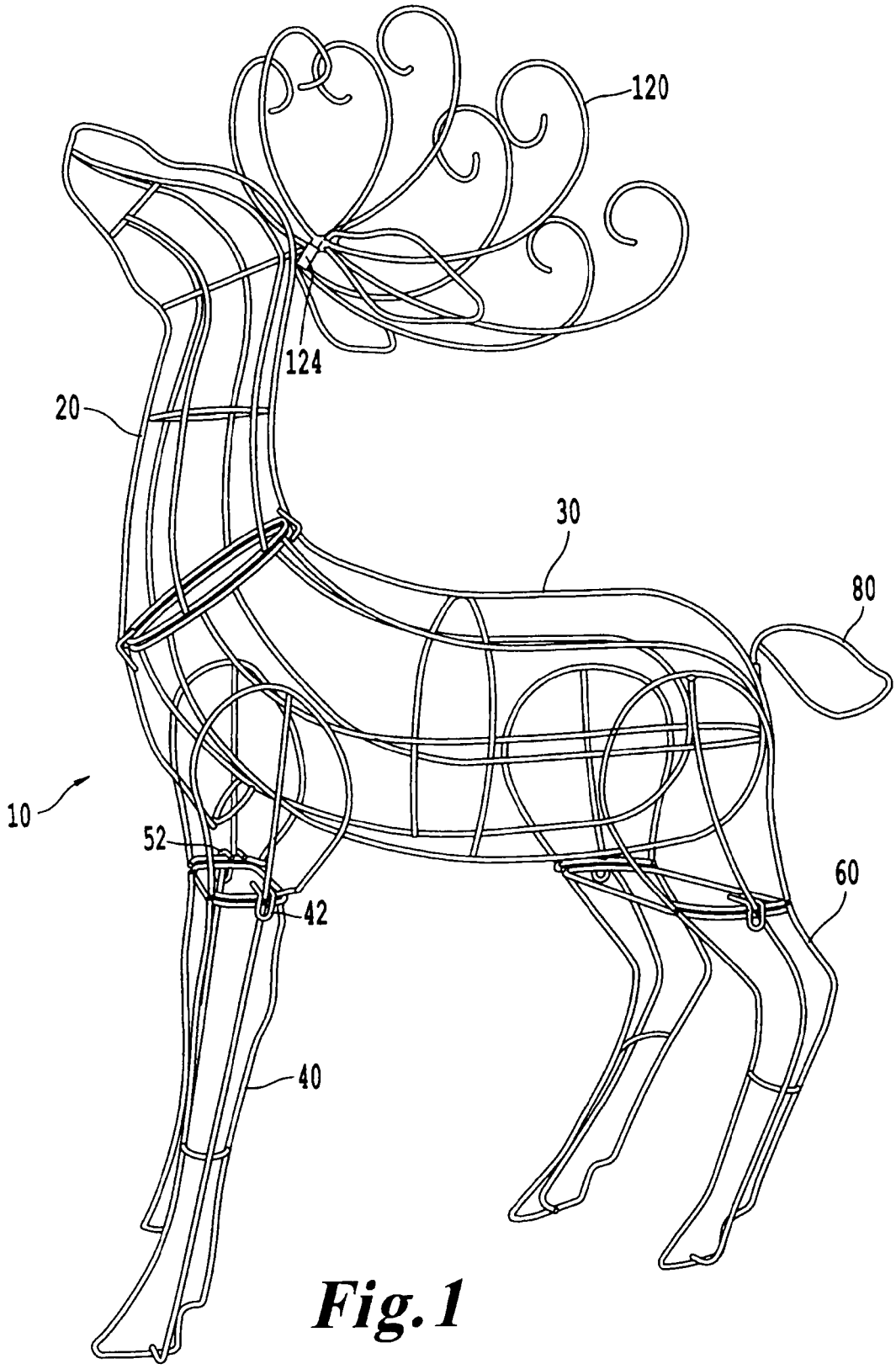
FIG. 1 shows a side view of an embodiment of the present invention without refractive elements.

Referring now to the drawings, wherein like reference numerals designate identical or corresponding parts throughout the several views.

Figure 2:
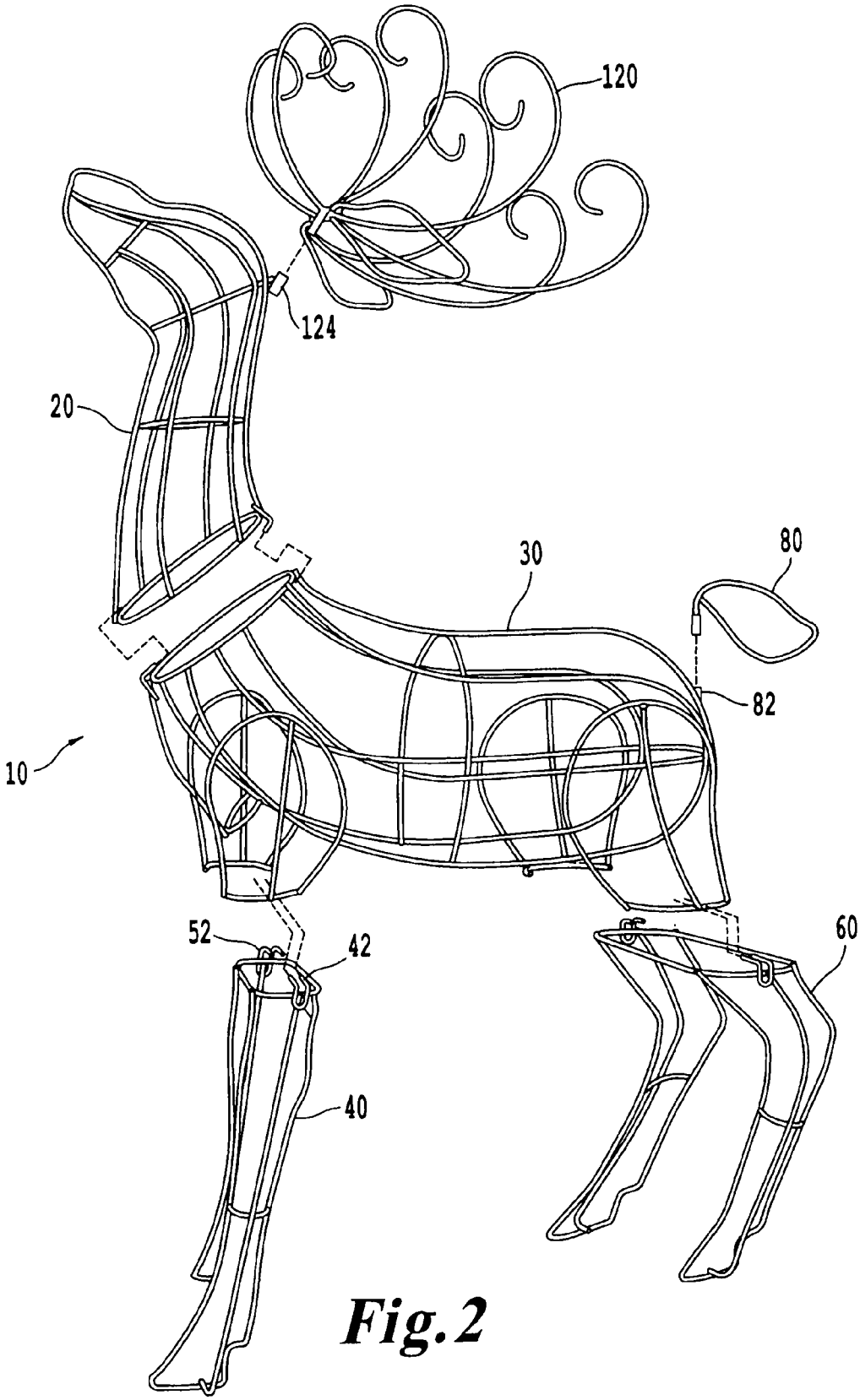
FIG. 2 shows another side view of an embodiment of the present invention without refractive elements.
Figure 3:
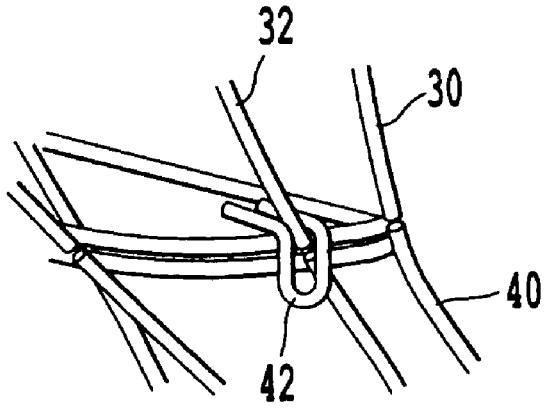
FIG. 3 shows a blown up view of an exemplary connector.

FIGS. 1 and 2 show a side view of an embodiment without refractive elements thereon. This embodiment is in the shape of a reindeer, but as noted later any shape is possible. Decorative lighting apparatus 10 includes head section 20 and body section 30. Decorative lighting apparatus 10 also includes front leg section 40, including two front legs, which is connected to body section 30 by leg attachments 42 and 52. Each leg attachment 42 and 52 can engage with a portion of body section 30. Enlarged leg attachment 42 is shown in FIG. 3. Leg attachment 42 includes prongs that can extend around both sides of bar 32 on body section 30 to engage front leg section 40 with body section 30. In a similar manner, leg attachment 52 also includes prongs that extend around both sides of another bar on an opposite side of body section 30. Thus, the opposing leg attachments 42 and 52 engage with body section 30 such that front leg section 40 can be removably attached thereto. Additional leg attachments could be used to attach front leg section 40 to body section 30. Rear leg section 60, which includes two rear legs, and head section 20 can each be attached to body section 30 in a manner similar to that of front leg section 40. Any fastener known in the art may be used to secure head section 20, front leg section 40, and rear leg section 60 to body section 30.

Figure 4:
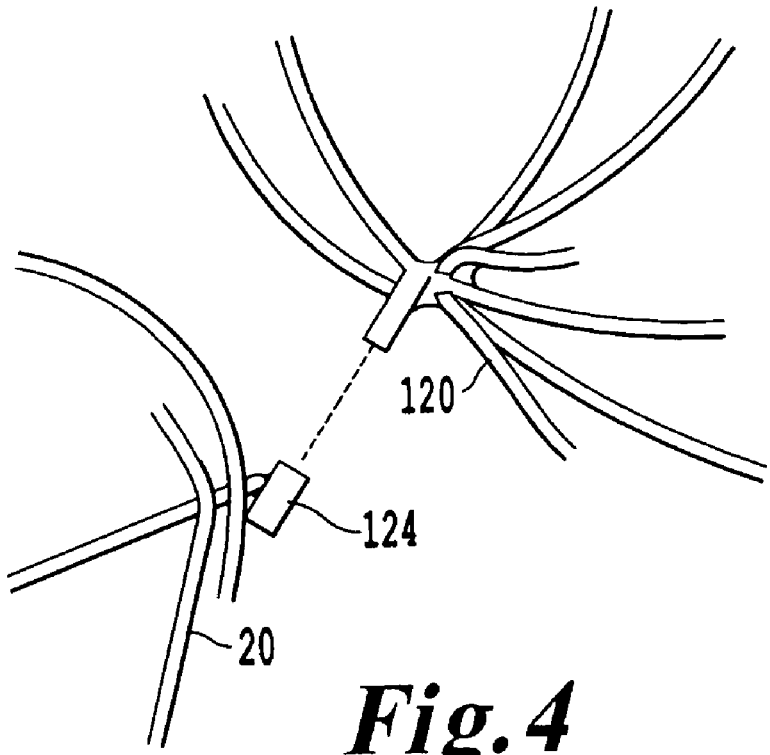
FIG. 4 shows a blown up view of another exemplary connector.

Antlers 120 can be connected to head section 20 by antlers receptacle 124. Antlers receptacle 124 forms a socket-type opening or sleeve in which antlers 120 can fit. As can be seen in FIG. 4, a portion of antlers 120 can fit within antlers receptacle 124. Of course, any method known in the art may be used to secure antlers 120 to head section 20.

As can be seen in FIG. 2, tail 80 can be connected to body section 30 by tail receptacle 82, similar to how antlers 120 can be connected to body section 30. However, as with antlers 120, any method known in the art may be used to secure tail 80 to body section 30.

Figure 5:
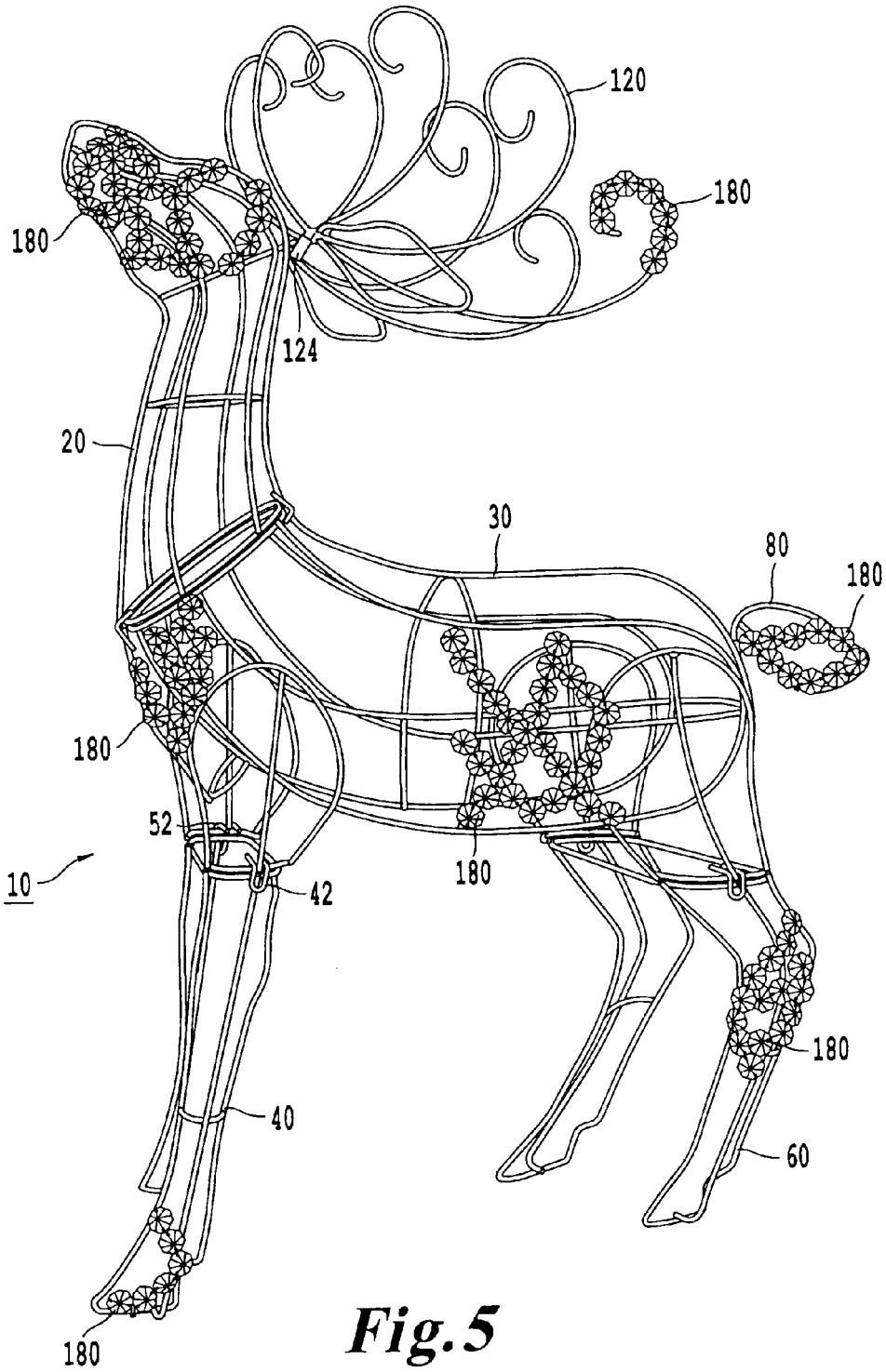
FIG. 5 shows a side view of an embodiment of the present invention including refractive elements.

Referring now to FIG. 5, attached on the outer surfaces of decorative lighting apparatus 10 is a plurality of refractive elements 180. Refractive elements 180 may be connected together to form a plurality of refractive strips. The refractive strips may cover decorative lighting apparatus 10. Typically, refractive elements 180 will cover a majority of decorative lighting apparatus 10. Refractive elements 180 may be transparent or translucent. Additionally, refractive elements 180 may be of any color.

Figure 6:
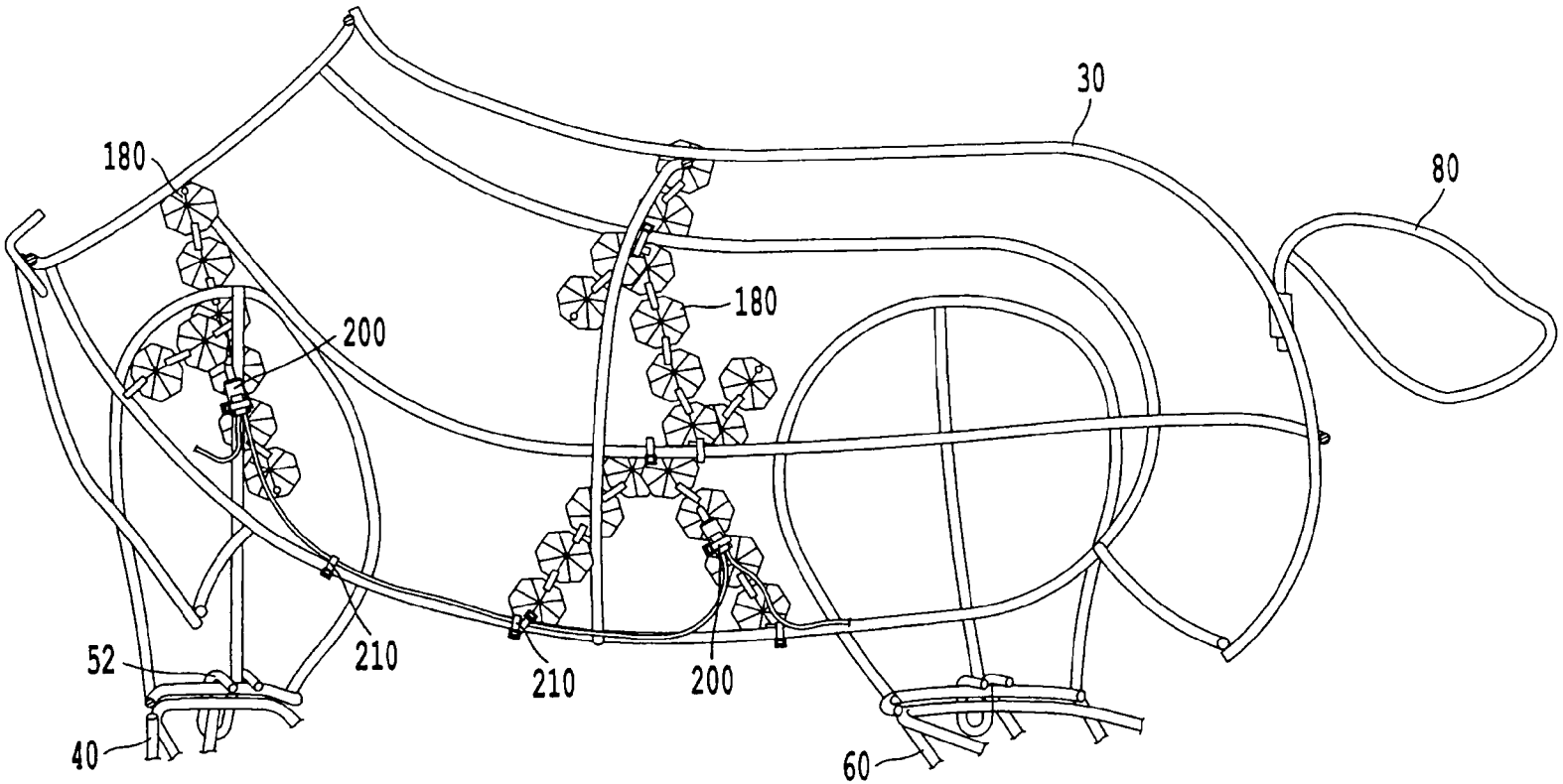
FIG. 6 shows a partial sectional view of an embodiment of the present invention including refractive elements.
Figure 7:
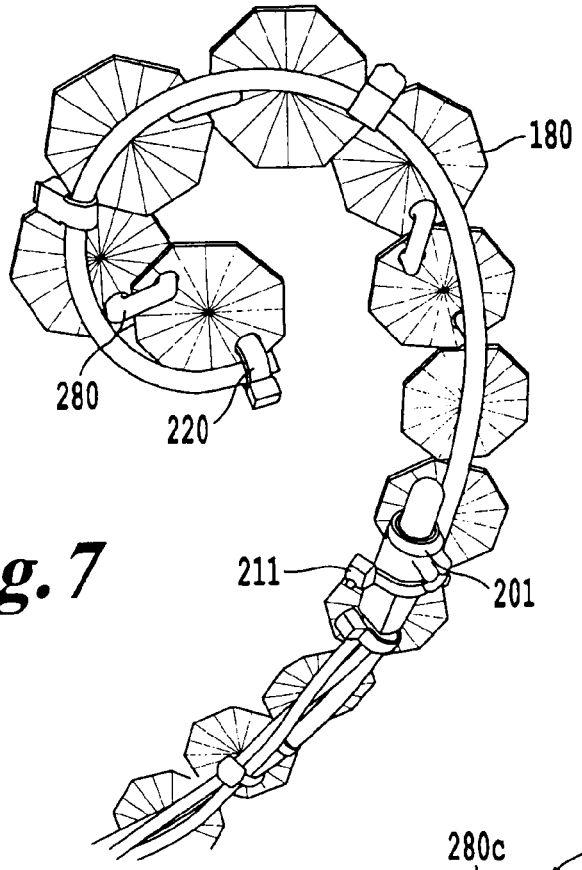
FIG. 7 shows a perspective blown up view of a reindeer's antlers and how the lighting element and refractive elements are attached to the body.

FIG. 6 shows a partial sectional view of decorative lighting apparatus 10. A plurality of lighting elements 200 can be arranged on decorative lighting apparatus 10. The plurality of lighting elements 200 can be directly connected to head section 20, body section 30, front leg section 40, rear leg section 60, tail 80, and antlers 120. FIG. 6 shows the plurality of lighting elements 200 being directly connected to body section 30, front leg section 40, rear leg section 60, and tail 80. Connectors 210 connect the plurality of lighting elements 200 to the various sections of decorative lighting apparatus 10. As can be seen in FIG. 7, an individual connector 211 is, in this embodiment, a plastic connector with a fastener at one end. Connector 211 is wrapped around a portion of an individual lighting element 201 and a portion of decorative lighting apparatus 10 to which the plurality of lighting elements 200 is to be connected. The other end of connector 211 is inserted into the fastener and secured thereon. This connector can also be any connector known in the art.

The plurality of lighting elements 200 may include any number of individual lighting elements. A lighting device, such as a light emitting diode (LED) may be used in the plurality of lighting elements 200. The LED may be a white LED. Similarly, the plurality of lighting elements 200 may be all connected together in a single light string, or may comprise a plurality of separate light strings. The plurality of lighting elements 200 may be positioned in positions other than those shown in the figures.

FIG. 7 also illustrates an isolated view of a single antler of antlers 120. The one antler is covered by a plurality of refractive elements 180. An individual lighting element 201 is positioned behind the plurality of refractive elements 180 such that light from the individual lighting element 201 would pass through the plurality of refractive elements 180 to create a pattern for a viewer from light refracted in different directions. One connector 211 connects the individual lighting elements 201 to the antler. The plurality of refractive elements 180 is connected to a frame of decorative lighting apparatus 10 via a plurality of connectors 220. Each of the plurality of connectors 220 is, in this embodiment, a plastic connector with a fastener at one end. The other end is inserted into the fastener and secured thereon. Each of the plurality of connectors 220 can also be any connector known in the art. The connective elements may be detachable from the refractive elements so as to allow an individual connective element or an individual refractive element to be removed from decorative lighting apparatus 10.

Figure 8:
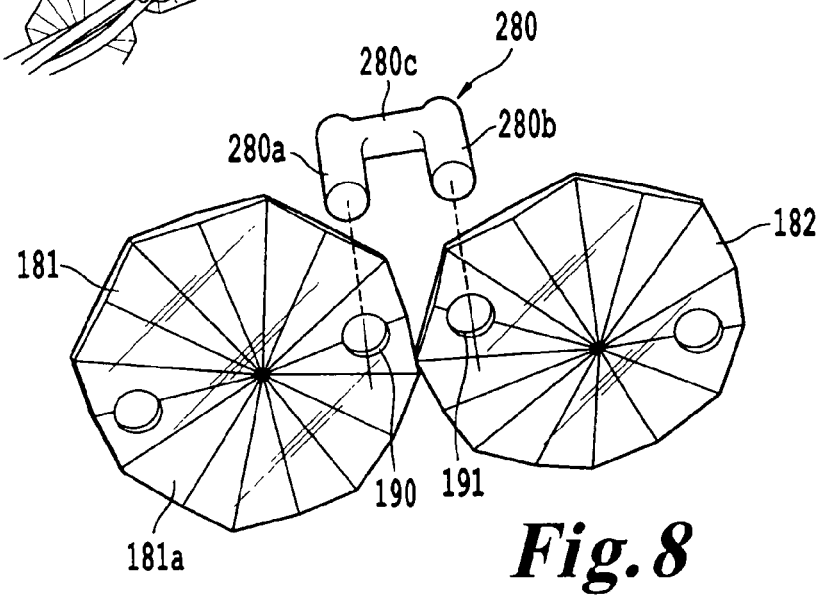
FIG. 8 shows two refractive elements fastened together with a connector.

FIG. 8 is an illustration of how two refractive elements 181, 182 of the plurality of refractive elements 180 are connected by connector 280. In FIG. 8, one refractive element 181 is connected to another refractive element 182 by connector 280. Connector 280 is, in this embodiment, a plastic connector with a center portion 280*c* and a fastener portion 280*a*, 280*b* at each end. Fastener portion 280*a* can be inserted into a hole 190 in refractive element 181 and fastener portion 280*b* can be inserted into a hole 191 in refractive element 182 to join the refractive elements together. The connector can be any connector known in the art. Any number of the plurality of refractive elements 180 can be connected to one another via connectors 280 to form refractive strips.

Figure 9:
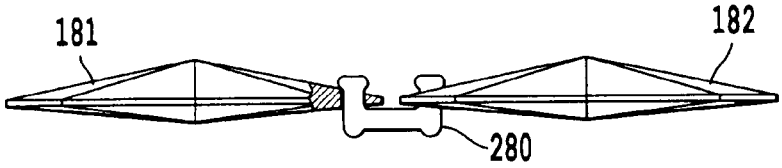
FIG. 9 shows a side view of two refractive elements fastened together with a connector.

FIG. 9 shows a side view of two refractive elements of the plurality of refractive elements 180 that are connected by a connector 280. In the exemplary embodiment shown in FIGS. 8 and 9, refractive element 181 has an octagonal shape. A rear face of refractive element 181, which faces downward in FIG. 9, would face an interior of decorative lighting apparatus 10. Refractive element 181 has a slightly raised center portion such that the rear face forms a pyramid with an octagonal base. A front face of refractive element 181, which faces an exterior of decorative lighting apparatus 10, has a raised center portion such that the front face forms another pyramid with an octagonal base. The center portion of the front face can be raised to a greater degree than the center portion of the rear face. Thus, as can be seen in FIG. 9, the refractive element 181 has a wedge shape. Each refractive element is capable of refracting light in different directions based on its orientation respective to each of the plurality of lighting elements 200. For example, when a white LED is used, one of the wedge shaped portions can act like a prism and split the white light into a rainbow spectrum.

Figure 10:
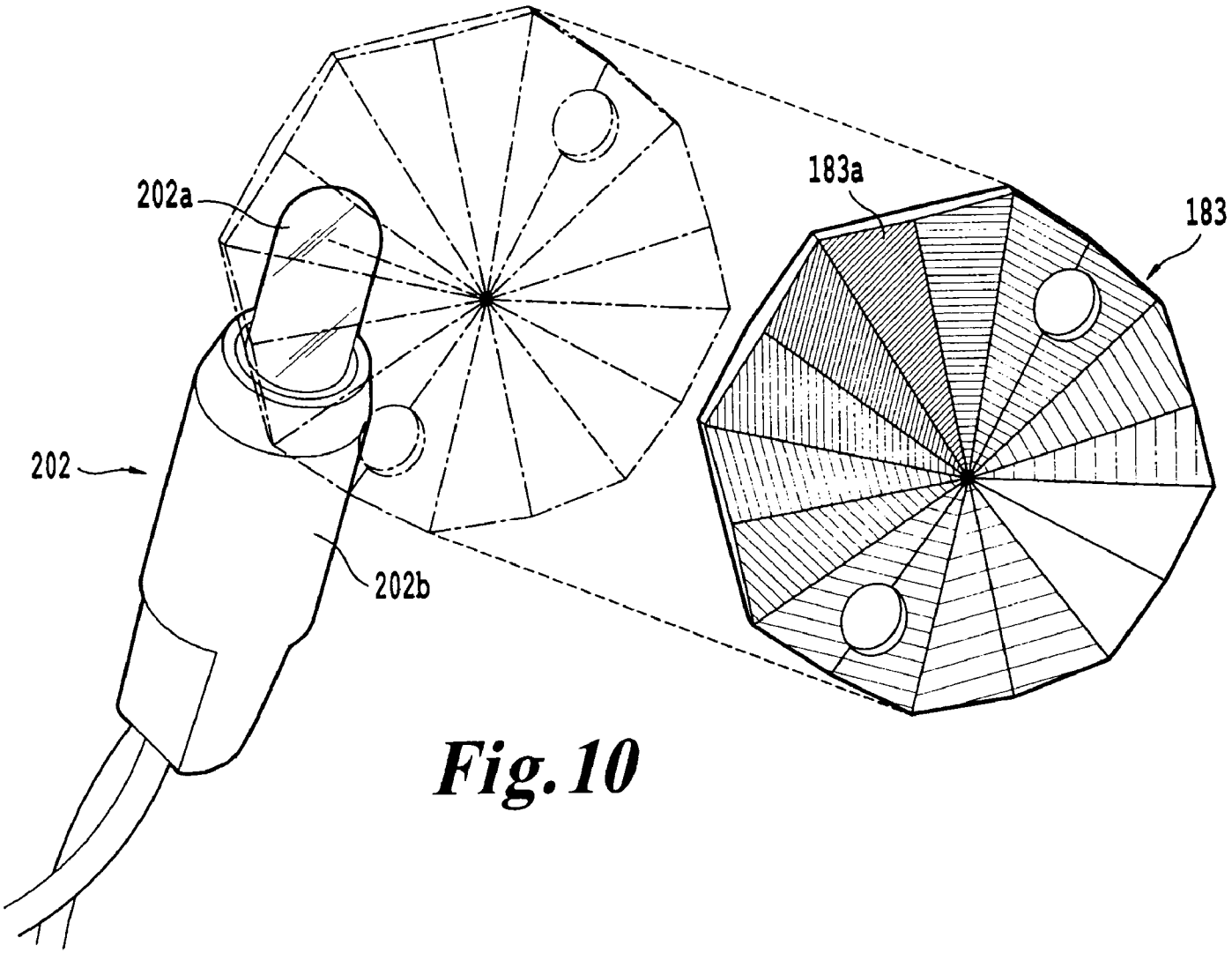
FIG. 10 shows a close-up illustration of a refractive element and a lighting element.

The effect of the plurality of lighting elements 200 on the plurality of refractive elements 180, to a viewer observing the plurality of refractive elements 180, is that each "wedge" of the pyramid formed by the front and back faces of each refractive element, such as element 183, will refract light from the lighting element to travel in a different direction (see FIG. 10). For example, sixteen wedges can be formed by the front and back faces of each refractive element (only one of the sixteen wedges, 181*a*, is labeled in FIG. 8 for clarity). Alternatively, a different number of wedges could be formed. In totality, decorative lighting structure 10 is illuminated by the plurality of lighting elements 200, each refracting light from the lighting elements to travel in different directions. Further, other shaped elements 180 can be used as long as they refract light in different directions.

When the light passes through the plurality of refractive elements, each refracts light from the lighting elements to travel in different directions, providing a pleasing visual appearance to an observer. Further, as the angle of incidence between each of the plurality of refractive elements is different, the refractive angles are also different. Thus, when the observer changes position with respect to the decorative lighting apparatus 10, the refractive angles continually change, creating an interesting visual effect. If the refractive elements cover the decorative lighting apparatus 10, the light refracted from the refractive elements can be viewed from any side of the decorative lighting apparatus 10.

For example, lighting element 202, composed in this embodiment of LED light 202*a* and socket 202*b*, illuminates refractive element 183 and the light in each wedge 183*a* of refractive element 183 is refracted in a different direction. A close up view of this may be seen in FIG. 10. As shown in FIG. 10, lighting element 202 illuminates refractive element 183, and refractive element 183 disperses the light by refracting it. In the left portion of FIG. 10, the relationship between lighting element 202 and refractive element 183 is shown. In the right portion of FIG. 10, the overall refractive effect is created by individual refractive wedges 183*a* (again, only a single wedge 183*a* is labeled for clarity) by illuminating refractive element 183 is shown. Different shading in each wedge 183*a* of refractive element 183 represents the different refractive effect created by each wedge 183*a*. Of course, depending on the arrangement of the lighting elements, the refractive effect can occur in different places on the refractive element such that the amount of light shining through different wedges would change. In fact, wedge 183*a* will separate the light by color as a prism does, as is known in the art. Thus, if lighting element 202 emits "white" light, wedge 183*a* will refract this light into a plurality of colors traveling in different directions.

FIGS. 1-10 show an embodiment of the invention where the decorative lighting appears as a reindeer but snowmen, angels, Santa Clauses, Christmas trees, drums, penguins, polar bears, snowflakes, pumpkins, trains, candy canes, stars, igloos, a nativity scene, etc. are also possible. These alternative structures could be made up of any number of sub sections or substructures. These modifications are within the scope of the invention as claimed.

Obviously, numerous modifications and variations of the present invention are possible in light of the above teachings. It is therefore to be understood that within the scope of the appended claims, the invention may be practiced otherwise than as specifically described herein.

The invention claimed is:

1. A decorative lighting apparatus, comprising:

a structure;

a plurality of light emitting elements configured to emit light;

a plurality of refractive elements each having a plurality of surfaces, wherein a front face of each of said plurality of refractive elements has a raised center portion that is thicker than an edge portion and plural surfaces are formed on the front face; and a plurality of connectors each including a substantially flat member, a first projection extending from the flat member, and a second projection extending from the flat member, wherein the first projection extends through a hole in one of said plurality of refractive elements and the second projection extends through a hole in an adjacent one of said plurality of refractive elements such that each of the connectors directly connects only two of said plurality of refractive elements, wherein the plurality of refractive elements is connected to said structure such that said plurality of light emitting elements is configured to emit said light through said plurality of refractive elements to a viewer to refract said light in a plurality of directions.

2. The decorative lighting apparatus recited in claim 1, wherein said structure is in a shape of a reindeer, the reindeer comprising:

a body section;

a head section;

front and rear leg sections;

antlers; and a tail.

3. The decorative lighting apparatus recited in claim 1, wherein each of said plurality of refractive elements has an octagonal shape.

4. The decorative lighting apparatus recited in claim 3, wherein sixteen surfaces are formed on the front face of each of said plurality of refractive elements.

5. The decorative lighting apparatus recited in claim 4, wherein a rear face of each of said plurality of refractive elements has a raised center portion.

6. The decorative lighting apparatus recited in claim 1, wherein said plurality of refractive elements covers a majority of each external surface of said structure.

7. The decorative lighting apparatus recited in claim 1, wherein at least one of said plurality of refractive elements is transparent.

8. The decorative lighting apparatus recited in claim 1, wherein at least one of said plurality of light emitting elements is a light emitting diode.

9. The decorative lighting apparatus recited in claim 1, wherein said plurality of light emitting elements is connected to said structure.

10. The decorative lighting apparatus recited in claim 1, wherein said plurality of refractive elements is located on all faces of said structure.

11. The decorative lighting apparatus recited in claim 1, wherein each of said plurality of refractive elements is connected to at least one other of said refractive elements by one of the plurality of connectors such that each adjacent pair of the refractive elements is connected by a different one of the connectors.

12. The decorative lighting apparatus recited in claim 1, wherein at least one of said plurality of refractive elements is directly connected to said structure.

13. The decorative lighting apparatus recited in claim 1, wherein each of said plurality of refractive elements includes a wedge shaped portion.

14. A decorative lighting apparatus, comprising:

a structure;

a plurality of means for emitting light;

a plurality of means for refracting light, wherein a front face of each of said plurality of means for refracting light has a raised center portion that is thicker than an edge portion and plural surfaces are formed on the front face; and a plurality of connectors each including a substantially flat member, a first projection extending from the flat member, and a second projection extending from the flat member, wherein the first projection extends through a hole in one of said plurality of means for refracting light and the second projection extends through a hole in an adjacent one of said plurality of means for refracting light such that each of the connectors directly connects only two of said plurality of means for refracting light, wherein the plurality of means for refracting light is connected to said structure such that said plurality of means for emitting light illuminates said means for refracting light to refract said light in a plurality of directions.

15. The decorative lighting apparatus recited in claim 14, wherein said structure is in a shape of a reindeer, the reindeer comprising:

a body section;

a head section;

front and rear leg sections;

antlers; and a tail.

16. The decorative lighting apparatus recited in claim 14, wherein each of said plurality of means for refracting light has an octagonal shape.

17. The decorative lighting apparatus recited in claim 16, wherein sixteen surfaces are formed on the front face of each of said plurality of means for refracting light.

18. The decorative lighting apparatus recited in claim 17, wherein a rear face of each of said plurality of means for refracting light has a raised center portion.

19. The decorative lighting apparatus recited in claim 14, wherein said plurality of means for refracting light covers a majority of each external surface of said structure.

20. The decorative lighting apparatus recited in claim 14, wherein at least one of said plurality of means for refracting light is transparent.

21. The decorative lighting apparatus recited in claim 14, wherein at least one of said plurality of means for emitting light is a light emitting diode.

22. The decorative lighting apparatus recited in claim 14, wherein said plurality of light emitting elements is connected to said structure.

23. The decorative lighting apparatus recited in claim 14, wherein said plurality of means for refracting light is located on all external faces of said structure.

24. The decorative lighting apparatus recited in claim 14, wherein each of said plurality of means for refracting light is connected to at least one other of said means for refracting light by one of the plurality of connectors such that each adjacent pair of the plurality of means for refracting light is connected by a different one of the connectors.

25. The decorative lighting apparatus recited in claim 16, wherein at least one of said plurality of means for refracting light is directly connected to said structure.

26. The decorative lighting apparatus recited in claim 14, wherein each of said plurality of means for refracting light includes a wedge shaped portion.

27. The decorative lighting apparatus recited in claim 1, wherein the one of said plurality of refractive elements is directly connected to the adjacent one of said plurality of refractive elements by only the connector and the connector is not directly connected to the structure.

28. The decorative lighting apparatus recited in claim 14, wherein the one of said plurality of means for refracting light is directly connected to the adjacent one of said plurality of means for refracting light by only the connector and the connector is not directly connected to the structure.

* * * * *